US011009200B1

(12) United States Patent
Ding

(10) Patent No.: US 11,009,200 B1
(45) Date of Patent: May 18, 2021

(54) LAMPSHADE AND FLAMELESS CANDLE COMPRISING THE SAME

(71) Applicant: Nantong Ya Tai Candle Arts & Crafts Co., Ltd., Nantong (CN)

(72) Inventor: Yingqi Ding, Nantong (CN)

(73) Assignee: NANTONG YA TAI CANDLE ARTS & CRAFTS CO., LTD., Nantong (CN)

( * ) Notice: Subject to any disclaimer, the term of this patent is extended or adjusted under 35 U.S.C. 154(b) by 0 days.

(21) Appl. No.: 17/005,367

(22) Filed: Aug. 28, 2020

(30) Foreign Application Priority Data

Jul. 22, 2020 (CN) ..... 202010708910.0

(51) Int. Cl.

| | |
|---|---|
| ***F21S 10/04*** | (2006.01) |
| ***F21S 9/02*** | (2006.01) |
| ***F21S 6/00*** | (2006.01) |
| ***F21V 1/14*** | (2006.01) |

(52) U.S. Cl.
CPC ..... *F21S 10/04* (2013.01); *F21S 6/001* (2013.01); *F21S 9/02* (2013.01); *F21V 1/146* (2013.01)

(58) Field of Classification Search
CPC ..... F21S 10/04; F21S 10/043; F21S 10/046; F21S 6/001; F21V 1/146
See application file for complete search history.

(56) References Cited

U.S. PATENT DOCUMENTS

| | | | | |
|---|---|---|---|---|
| 3,233,093 | A * | 2/1966 | Gerlat | F21V 23/0407 362/205 |
| 3,681,588 | A * | 8/1972 | Lee | F21S 6/00 362/569 |
| 4,550,363 | A * | 10/1985 | Sandell | H01K 1/28 362/351 |
| 10,060,586 | B1 * | 8/2018 | Chen | F21S 6/001 |
| 10,436,396 | B2 * | 10/2019 | Cao | F21S 6/001 |
| 10,578,281 | B2 * | 3/2020 | Dong | F21V 19/0025 |
| 2005/0169812 | A1 * | 8/2005 | Helf | A01M 1/04 422/123 |
| 2006/0115386 | A1 * | 6/2006 | Michaels | F21S 10/04 422/123 |
| 2007/0223216 | A1 * | 9/2007 | Jensen | F21S 9/02 362/161 |

(Continued)

FOREIGN PATENT DOCUMENTS

CN 206280888 U * 6/2017 ..... F21V 3/02

*Primary Examiner* — Alexander K Garlen
(74) *Attorney, Agent, or Firm* — Matthias Scholl P.C.; Matthias Scholl

(57) ABSTRACT

A lampshade including a lampstand and a flame body. The lampstand includes a hollow column. The flame body is an integrated structure including a first curved surface, a second curved surface, and a first cavity defined by the first curved surface and the second curved surface. The first curved surface is perpendicularly disposed on the lampstand. The second curved surface is aslant disposed on the lampstand with respect to the first curved surface. The first curved surface and the second curved surface each include a top edge, two side edges, and a bottom edge. The bottom edge of the second curved surface and a connection line of two end points of the bottom edge of the first/second curved surface form a semicircular opening. The hollow column includes a first through hole corresponding to the semicircular opening in shape and size.

10 Claims, 7 Drawing Sheets

(56) References Cited

U.S. PATENT DOCUMENTS

| | | | | |
|---|---|---|---|---|
| 2008/0117633 | A1* | 5/2008 | Li | F21S 6/001 362/253 |
| 2011/0134628 | A1* | 6/2011 | Pestl | F21V 33/004 362/96 |
| 2014/0035483 | A1* | 2/2014 | Becker | F21V 23/0442 315/294 |
| 2014/0211499 | A1* | 7/2014 | Fong | F21S 6/001 362/558 |
| 2014/0268706 | A1* | 9/2014 | Yang | F21V 3/062 362/186 |
| 2015/0354769 | A1* | 12/2015 | Patton | F21S 10/043 362/231 |
| 2020/0217469 | A1* | 7/2020 | Fan | F21S 10/046 |

* cited by examiner

LAMPSHADE AND FLAMELESS CANDLE COMPRISING THE SAME

CROSS-REFERENCE TO RELAYED APPLICATIONS

Pursuant to 35 U.S.C. § 119 and the Paris Convention Treaty, this application claims foreign priority to Chinese Patent Application No. 202010708910.0 filed Jul. 22, 2020, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to a lampshade and a flameless candle comprising the same.

A candle includes an ignitable wick embedded in wax. When the wick is lighted, the wax is melted and vaporized, and the candle begins to burn and an open flame is produced. This may cause fire hazard.

In recent years, the flameless candles have been developed. To simulate the flickering flame, the flameless candles are equipped with complex structures, such as a swingable lamp body, or using two light-emitting elements to shine the flame head alternately. However, the beam angle of the light-emitting elements is inflexible, so that the simulation effect of the flickering flame is unrealistic.

Conventional lampshades of the flameless candles are an ellipsoidal or cylindrical plastic, which exhibits an unsatisfactory effect upon converging the direct lights for the flameless candles.

SUMMARY

The disclosure provides a lampshade comprising a lampstand and a flame body. The lampstand comprises a hollow column configured to accommodate a lamp bead of a flameless candle. The flame body is an integrated structure comprising a first curved surface, a second curved surface, and a first cavity defined by the first curved surface and the second curved surface.

The first curved surface is perpendicularly disposed on the lampstand; the second curved surface is aslant disposed on the lampstand with respect to the first curved surface; the first curved surface and the second curved surface each comprise a top edge, two side edges, and a bottom edge; corresponding top edges and side edges are bonded to each other to form the first cavity; the bottom edge of the second curved surface and a connection line of two end points of the bottom edge of the first/second curved surface form a semicircular opening; and the hollow column comprises a first through hole corresponding to the semicircular opening in shape and size.

The flame body is a milky white semitransparent plastic; and the connection line is coincident with the center line of the surface of the lampstand oriented to the flame body.

The lampstand further comprises a base plate disposed below the hollow column; a diameter of the base plate is larger than that of the hollow column; and the hollow column is disposed on and internally tangent with the base plate.

The base plate comprises a second through hole to allow the lamp bead of the flameless candle to pass through the base plate; and the second through hole and the first through hole are eccentrically disposed thereby preventing the tip of the lamp bead of the flameless candle from extending into the first cavity.

The lampshade further comprises an annular support disposed below the base plate; the annular support comprises a third through hole disposed in the center of the annular support; the third through hole is covered by the base plate and a mounting base is detachably disposed in the third through hole; and the lamp bead of the flameless candle is fixed in the mounting base.

The disclosure further provides a flameless candle, comprising a first housing comprising a second cavity; the aforesaid lampshade disposed on one end of the first housing; a lamp bead disposed in the lampstand; and a power source. The lamp bead comprises a second housing, at least two light-emitting elements, and a circuit board. The power source is disposed in the second cavity.

The at least two light-emitting elements and the circuit board are disposed in the second housing; the at least two light-emitting elements each comprise a head tilted towards the first curved surface; the circuit board is configured to control the at least two light-emitting elements to emit lights with varying brightness; and the power source is electrically connected to the circuit board.

The circuit board is configured to output a control signal to control the at least two light-emitting elements to emit lights with irregular varying brightness, and the change frequency of the brightness of the lights of the at least two light-emitting elements is different from one another; and the change cycle of the control signal is 3-10 s.

The circuit board comprises a first end and a second end; the at least two light-emitting elements are electrically connected to the first end of the circuit board; the second end is provided with two guide pillars electrically connected to positive and negative terminals of the power source, respectively; and the power supply is a dry battery or a rechargeable battery.

The one end of the first housing comprises an opening; the hollow column is rotatably disposed in the opening through screw thread whereby a height of the flame body is adjustable.

The circuit board comprises a remote module in wireless communication with an external remote controller provided with a switch button, a timing button and a flame intensity button; when in use, the external remote controller controls power on, power off, timing lighting and luminous intensity of the flameless candle through the circuit board.

The following advantages are associated with the flameless candle according to embodiments of the disclosure.

The flame body comprises the first curved surface and the second curved surface, and the lamp bead of the flameless candle is disposed in the first cavity formed by the first curved surface and the second curved surface, so that the light emitted from the lamp bead of the flameless candle irradiates the special-shaped lampshade, and the emergent light scatters on the inner surface of the first curved surface, thereby producing a flame effect viewed from outside of the first curved surface. At the same time, the reflected lights generated on the inner surface of the first curved surface is converged on the inner surface of the second curved surface, thereby producing another flame effect viewed from outside of the second curved surface. The entire special-shaped lampshade adopts a shape of a candle light, which can achieve a three-dimensional display of a realistic flame of a candle light.

The flameless candle of the disclosure can comprise only one lamp bead vertically disposed in the mounting base to simulate the flickering effect of flames, thus simplifying the structure of the flameless candle compared with a conventional one, reducing the processing cost of the mounting base, and facilitating the fixation and replacement of the flame bead. The flameless candle of the disclosure comprises at least two light-emitting elements which can emit lights with varying brightness, and the frequency of the light emission, i.e. the change period of the light brightness, is irregular, thus improving the simulation effect of flickering flames.

Figure 1:
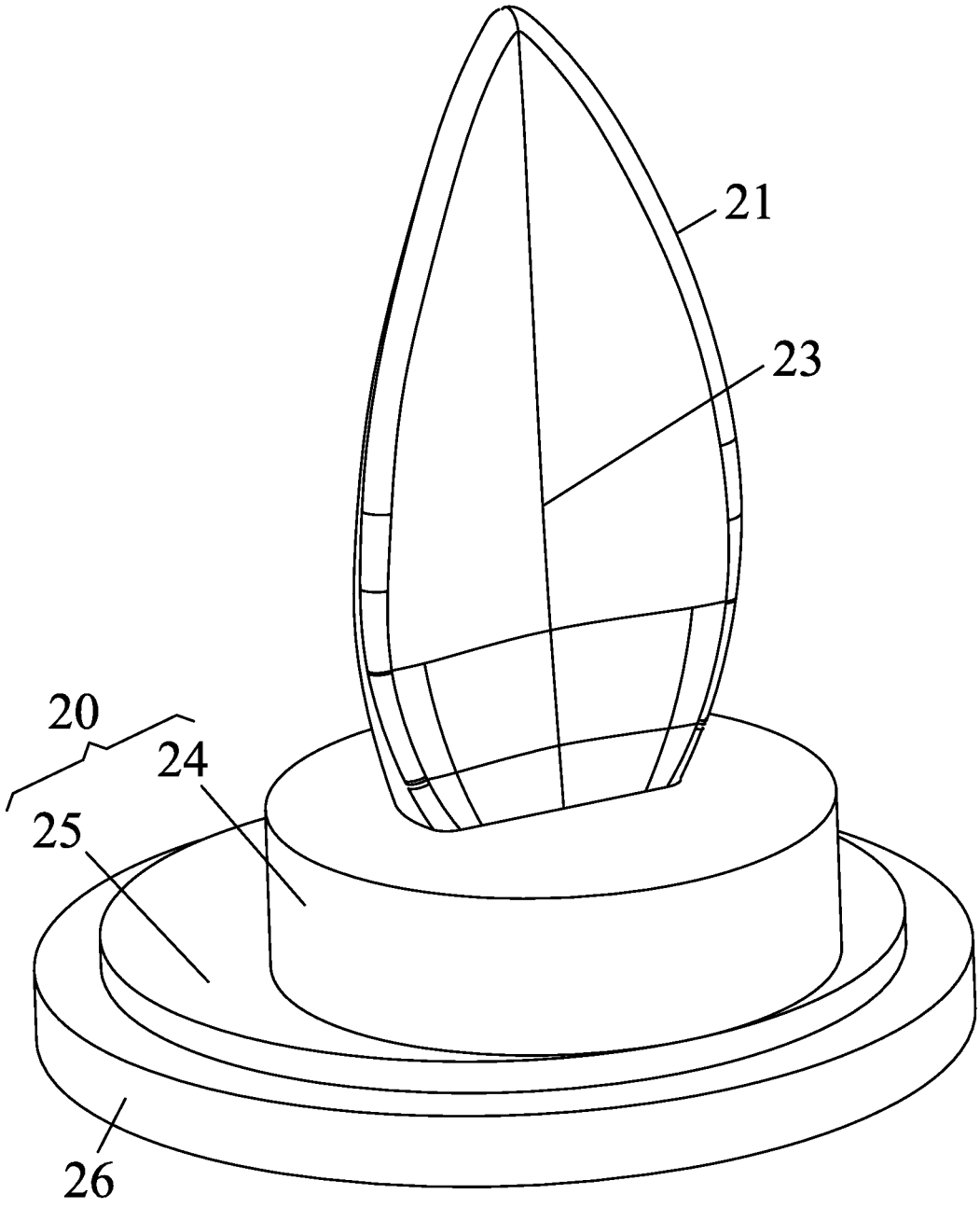
FIG. 1 is a schematic diagram of a lampshade according to one embodiment of the disclosure.

In the drawings, the following reference numbers are used: 1. First housing; 2. Lampshade; 20. Lampstand; 21. Flame body; 22. Second curved surface; 23. First curved surface; 24. Hollow column; 25. Base plate; 26. Annular support; 27. First through hole; 28. Second through hole; 29. Third through hole; 3. Lamp bead; 4. Second housing; 5. Light-emitting element; 51. First light-emitting element; 52. Second light-emitting element; 6. Circuit board; 7. Power source; 8. Guide pillar; 9. Mounting base; 10. Reflector; 11. Base; 12. Control switch.

DETAILED DESCRIPTION

To further illustrate, embodiments detailing a flameless candle are described below. It should be noted that the following embodiments are intended to describe and not to limit the disclosure.

Figure 2:
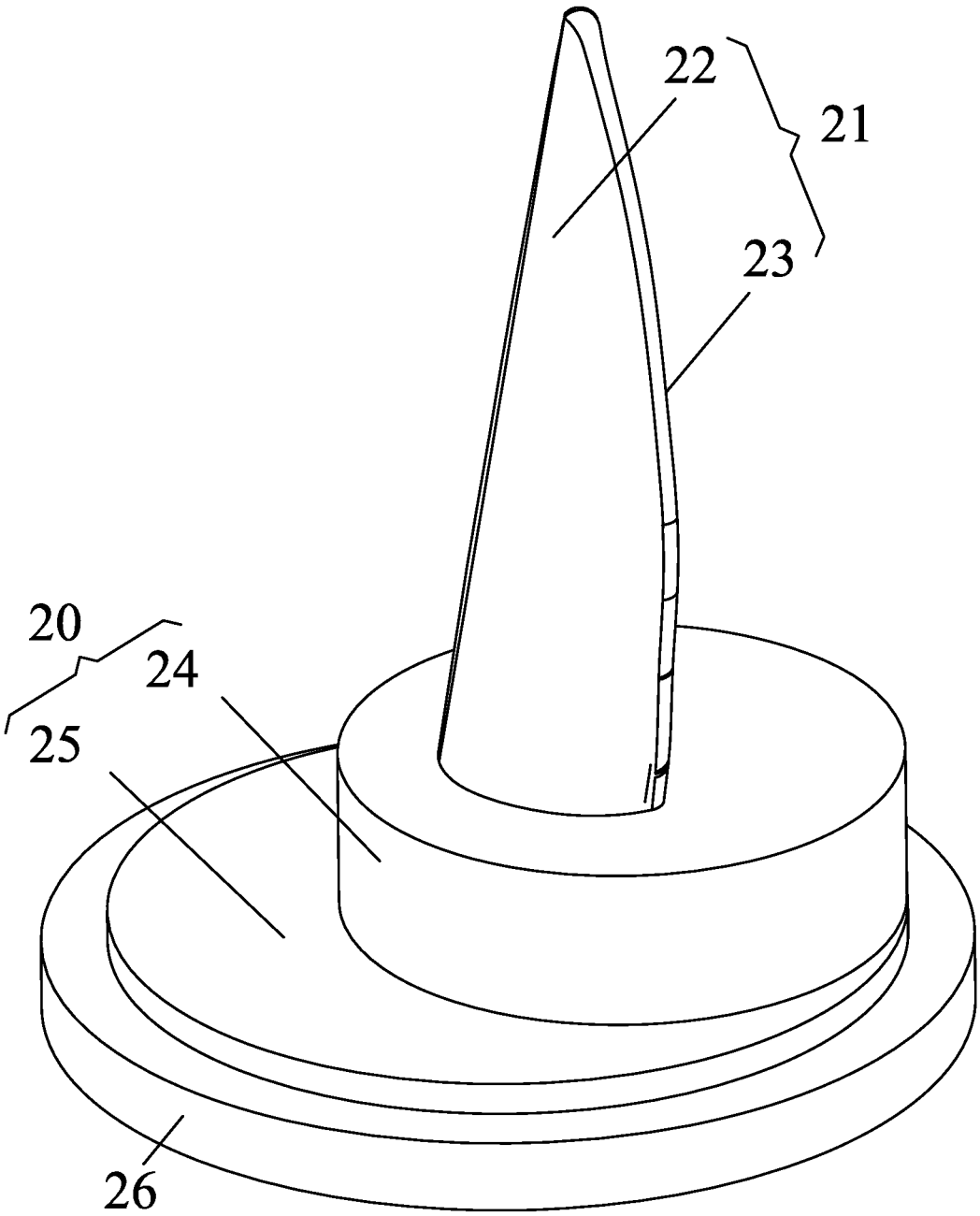
FIG. 2 is another schematic diagram of a lampshade according to one embodiment of the disclosure.
Figure 3:
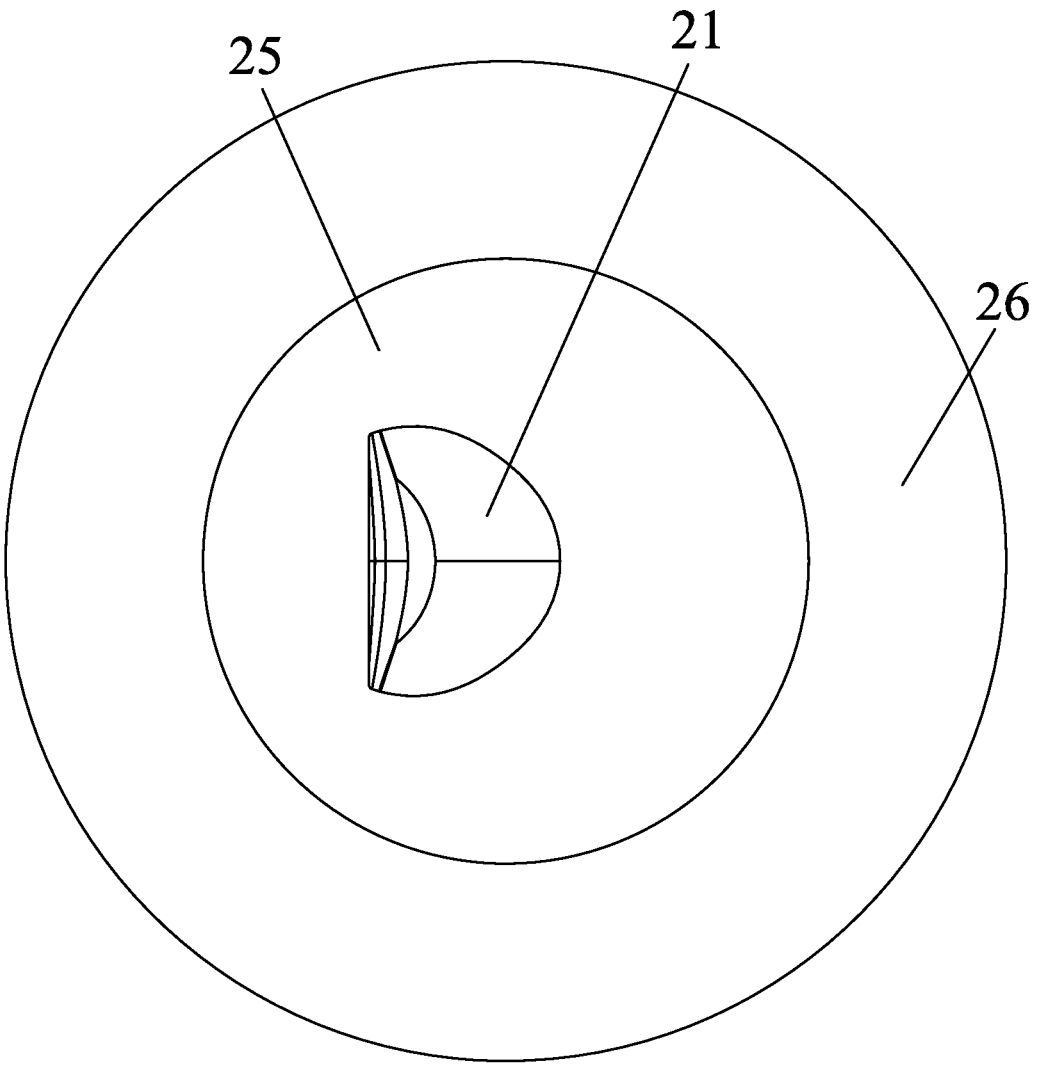
FIG. 3 is a bottom view of a lampshade according to one embodiment of the disclosure.

As shown in FIGS. 1-3, the disclosure provides a lampshade 2 comprising a lampstand 20 and a lampshade 2. The lampstand 20 comprises a hollow column 24 configured to accommodate a lamp bead of a flameless candle. The flame body is an integrated structure comprising a first curved surface 23, a second curved surface 22, and a first cavity defined by the first curved surface 23 and the second curved surface 22. The first curved surface 23 is perpendicularly disposed on the lampstand 20; the second curved surface 22 is aslant disposed on the lampstand 20 with respect to the first curved surface 23; the first curved surface 23 and the second curved surface 22 each comprise a top edge, two side edges, and a bottom edge; corresponding top edges and side edges are bonded to each other to form the first cavity; the bottom edge of the second curved surface 22 and a connection line of two end points of the bottom edge of the first/second curved surface form a semicircular opening; the hollow column 24 comprises a first through hole 27 corresponding to the semicircular opening in shape and size.

The flame body comprises the first curved surface 23 and the second curved surface 22, and the lamp bead of the flameless candle is disposed in the first cavity formed by the first curved surface 23 and the second curved surface 22, so that the light emitted from the lamp bead of the flameless candle irradiates the special-shaped lampshade 2, and the emergent light scatters on the inner surface of the first curved surface 23, thereby producing a flame effect viewed from outside of the first curved surface 23. At the same time, the reflected lights generated on the inner surface of the first curved surface 23 is converged on the inner surface of the second curved surface 22, thereby producing another flame effect viewed from outside of the second curved surface 22. The entire special-shaped lampshade 2 adopts a shape of a candle light, which can achieve a three-dimensional display of a realistic flame of a candle light.

In certain embodiment, the lampshade 2 is a milky white semitransparent plastic, the color of which is similar to that of common wax. The light emitted from the lamp bead can penetrate the semitransparent plastic, and can be reflected in the first cavity, thus presenting a three-dimensional effect of the candle flame.

In certain embodiment, the connection line is coincident with the center line of the top surface of the lampstand 20. In this way, the first curved surface 23 of the lampshade 2 functions as a main converging surface arranged in the center of the lampstand to simulate the luminous part of the flameless candle precisely.

In certain embodiment, the lampstand 20 further comprises a base plate 25 disposed below the hollow column 24; the diameter of the base plate is larger than that of the hollow column; and the hollow column 24 is disposed on and internally tangent with the base plate 25. In this way, the hollow column 24 is eccentrically disposed on the base plate 25. The base plate 25 functions as a limit plate of the top part of the housing of the flameless candle, and the lampshade 2 is entirely positioned in the center of the base plate 25, thus facilitating the installation of the lamp bead.

In certain embodiment, the base plate 25 comprises a second through hole 28 to allow the lamp bead of the flameless candle to pass through the base plate 25; and the second through hole 28 and the first through hole 27 are eccentrically disposed thereby preventing the tip of the lamp bead of the flameless candle from extending into the first cavity. The design facilitates the installation of the lamp bead, limits the position of the lamp bead, prevents the lamp bead from extending into the first cavity, and prevents the separation and disconnection between the candle light and the flame body visually, thus producing realistic simulation effect of candle light.

In certain embodiment, the lampshade further comprises an annular support 26 disposed below the base plate 25. The annular support comprises a third through hole 29 disposed in a center of the annular support; the third through hole is covered by the base plate 25 and a mounting base 9 is detachably disposed in the third through hole 29; and the lamp bead of the flameless candle is fixed in the mounting base 9.

Figure 4:
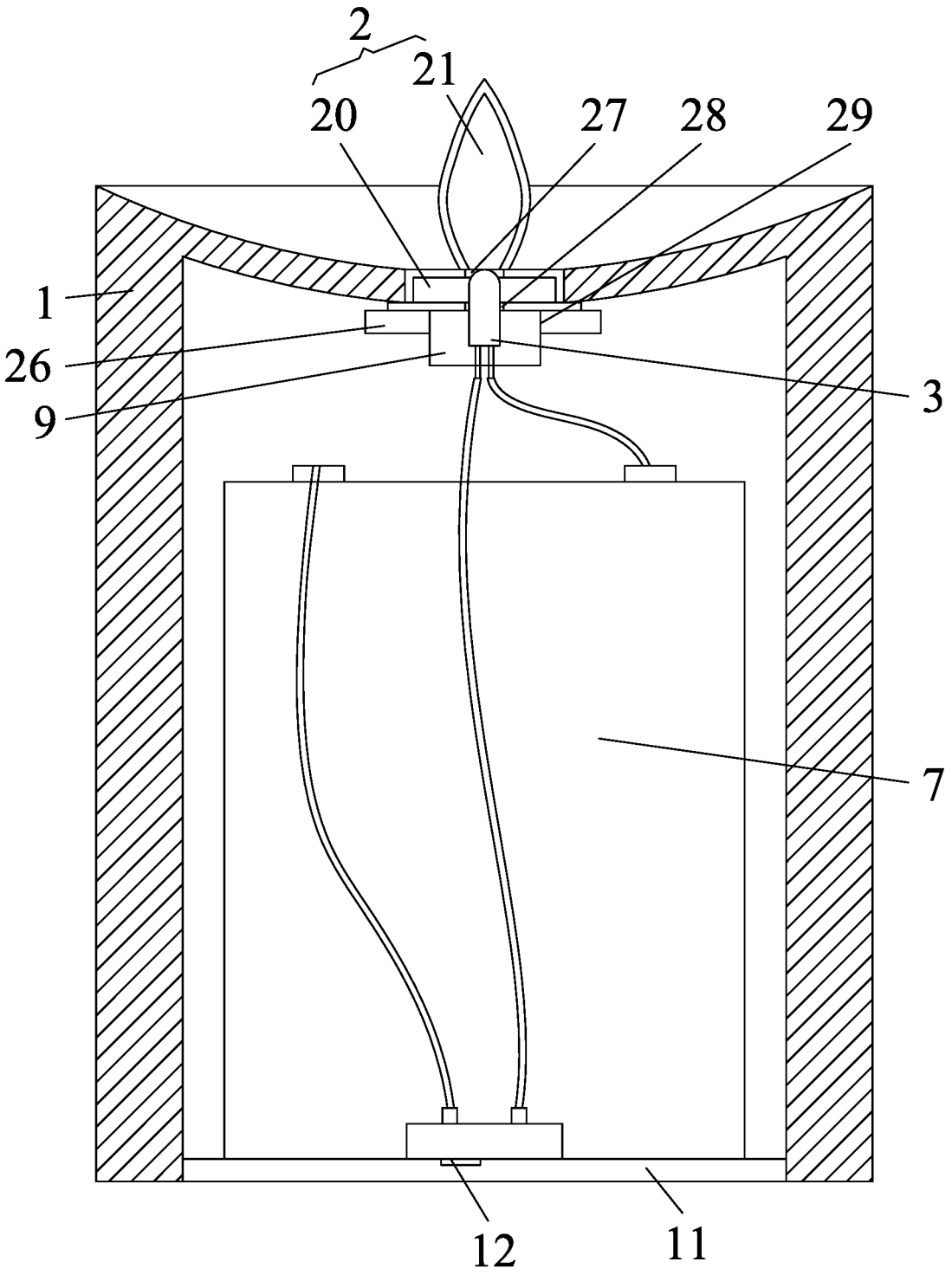
FIG. 4 is a schematic diagram of a flameless candle according to one embodiment of the disclosure.

In certain embodiments, the disclosure further provides a flameless candle, as shown in FIG. 4, comprising a first housing 1, the aforesaid lampshade 2, a lamp bead 3, and a power source 7. The first housing comprises a second cavity. The lampshade 2 is disposed on one end of the first housing. The lamp bead is disposed in the lampstand and comprises a second housing 4, at least two light-emitting elements 5, and a circuit board 6. The power source 7 is disposed in the second cavity. The at least two light-emitting elements 5 and the circuit board 6 are disposed in the second housing 4. The at least two light-emitting elements 5 each comprise a head tilted towards the first curved surface 23. The circuit board 6 is configured to control the at least two light-emitting elements 5 to emit lights with varying brightness; and the power source 7 is electrically connected to the circuit board 6.

Figure 5:
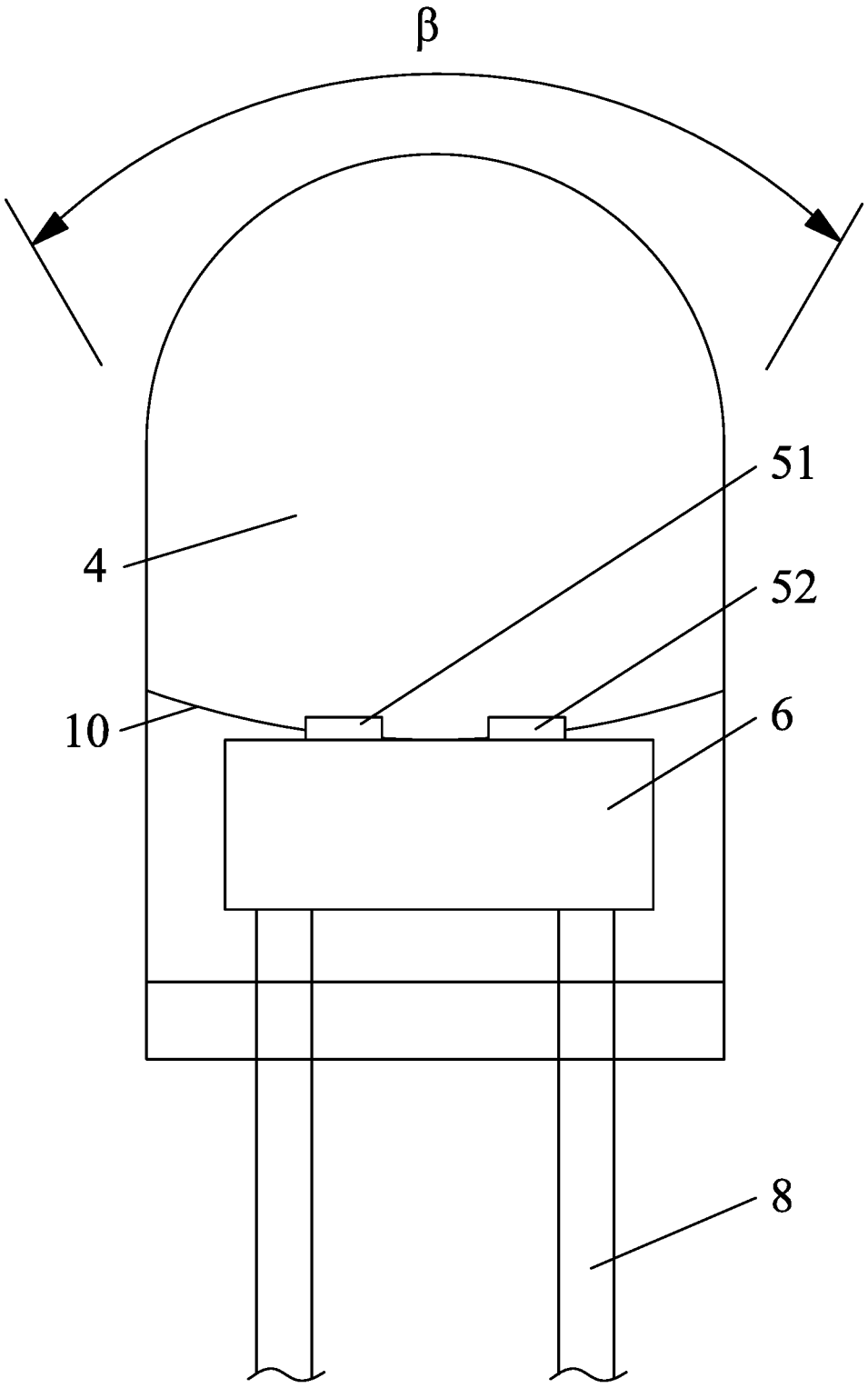
FIG. 5 is a front view of a lamp bead of a flameless candle according to one embodiment of the disclosure.

As shown in FIG. 5, the luminous brightness of the at least two light-emitting elements 5 in the lamp bead 3 is variable under the control of the circuit board 6 thereby achieving the flame simulation effect. Optionally, as needed, three light-emitting elements 5 can be disposed in the lamp bead to produce a flickering effect. In the following description, the flameless candle comprises two light-emitting elements 5, that is, a first light-emitting element 51 and a second light-emitting element 52.

In certain examples, the second housing 4 employs a colloidal structure with a transparent cover. In the process of shaping the lamp bead 3, the light-emitting elements are packaged in the colloidal structure using a traditional LED packaging method. For example, epoxy resin can be used for the packaging. The light-emitting elements 5 can emit a monochromatic light including but not limited to white, yellow, blue, or a polychromatic light thereof, thereby obtaining the simulation effect of different colors of a flame.

In certain examples, the circuit board 6 comprises a control chip connected to the first light-emitting element 51 and the second light-emitting element 52 through gold wires. The circuit board 6 outputs a varying current to the first light-emitting element 51 and the second light-emitting element 52 according to a control signal for lighting adjustment, and the first light-emitting element 51 and the second light-emitting element 52 both emit flickering lights.

In certain examples, the circuit board 6 is configured to output a control signal to control the at least two light-emitting elements 5 to emit lights with irregular varying brightness, and the change frequency of the brightness of the lights of the at least two light-emitting elements is different from one another; and the change cycle of the control signal is 3-10 s Through the irregular change of luminous brightness, the flickering effect of the flame light is simulated. At the same time, the change frequency of the luminous brightness of each light-emitting element 5 is different from one another, thus realizing the simultaneous flickering effect of a plurality of flame lights, and the simulation effect is more realistic. Although the control signals of different light-emitting elements 5 are different, the overall change period of the control signals is designed to be consistent, thus reducing the design cost of the circuits and ensuring the stability of the candle flames.

In certain examples, as shown in FIG. 5, the circuit board 6 comprises a first end and a second end; the at least two light-emitting elements 5 are electrically connected to the first end of the circuit board; the second end is provided with two guide pillars 8 electrically connected to positive and negative terminals of the power source 7. The power source is a dry battery or a rechargeable battery.

When a rechargeable battery is adopted, the bottom side of the first housing 1 is provided with a charging interface for charging the battery. The charging interface is connected to a charger through a USB data line, so that a plug of the charger is inserted into a household socket to charge the battery. The charging interface can also be connected to a notebook or mobile power supply through a USB data line to realize charging of the battery. Optionally, a wireless inductance module can be installed in the first housing 1 to communicate with an external wireless charging stand to realize wireless charging of the battery of the flameless candle.

In certain examples, the one end of the first housing 1 comprises an opening; the hollow column 24 is rotatably disposed in the opening; the hollow column is rotatably disposed in the opening through screw thread whereby the height of the lampshade 2 is adjustable.

Through the threaded connection of the flame body in the opening, the height of the lampshade 2 can be adjusted, and then the lampshade 2 can ascend or descend in the vertical direction. As needed, a user can adjust the height of the lampshade 2, so as to control the illumination brightness of the entire simulated flame extending out of the first housing 1, thus exhibiting realistic visual atmosphere of the candle light. The base plate 25 of the lampstand 20 can prevent the lampshade 2 from detaching from the first housing 1 caused by the excessive rotation of the lampshade 2. At the same time, the arrangement of the mounting base can ensure that the highest point of the bottom of the flame body 21 cannot exceed the highest top surface of the first housing 1 during the adjustment process of the lamp head, thus ensuring the authenticity of the flame combustion, and preventing the separation and disconnection between the candle light and the flame body visually.

Figure 6:
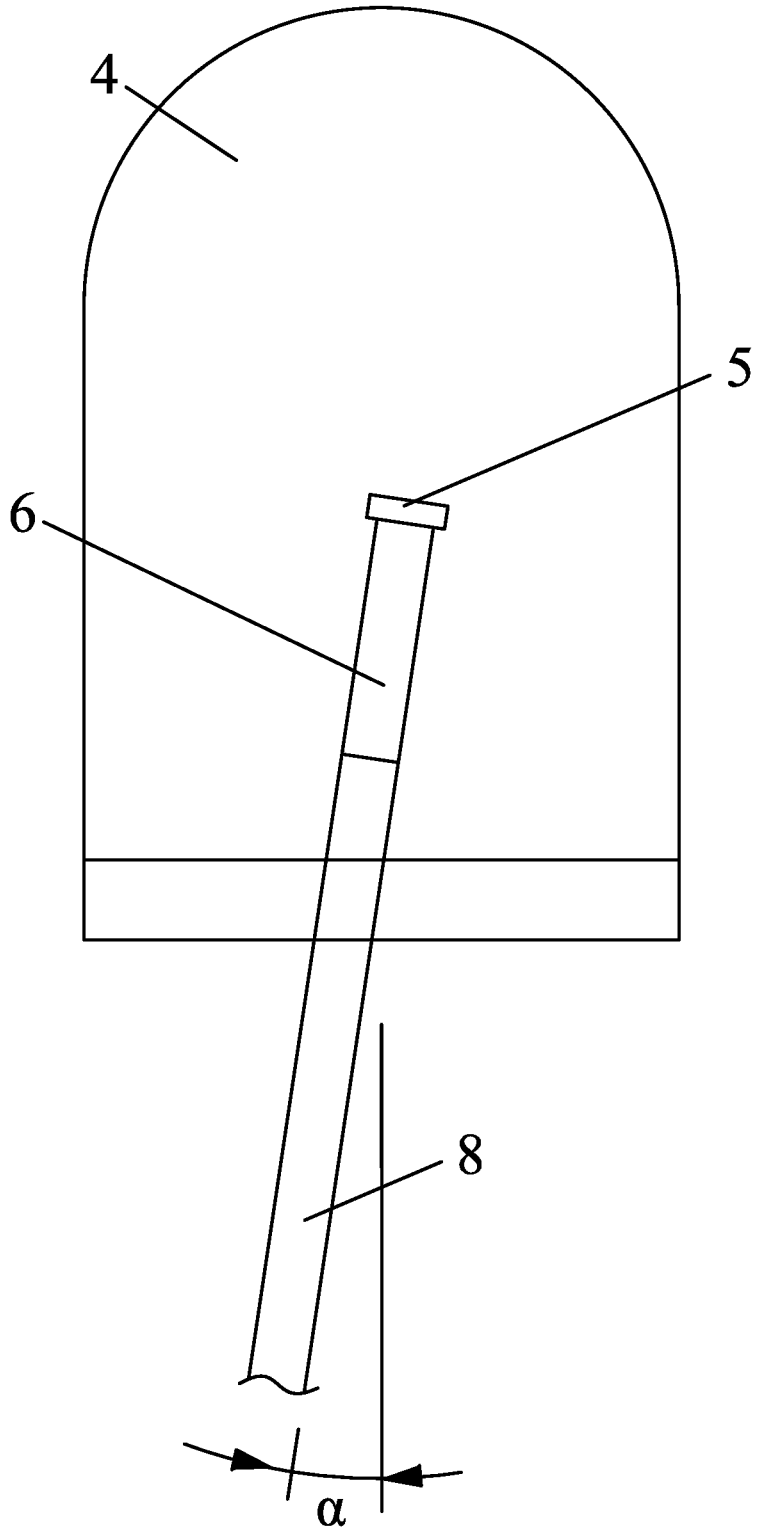
FIG. 6 is a side view of a lamp bead of a flameless candle according to one embodiment of the disclosure.
Figure 7:
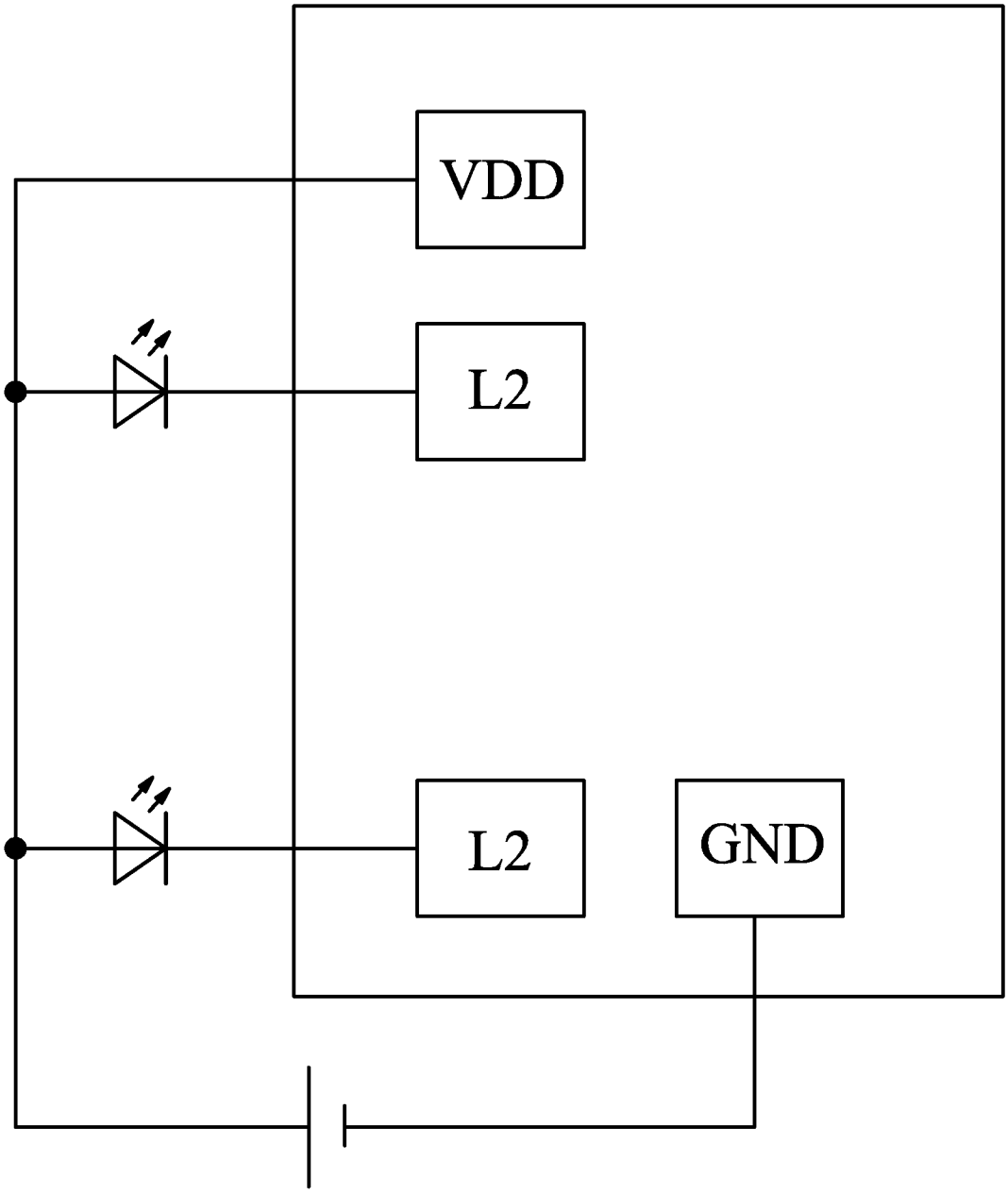
FIG. 7 is a circuit diagram of a circuit board according to one embodiment of the disclosure.

In certain examples, as shown in FIG. 6, the at least two light-emitting elements 5 are disposed at an identical horizontal height; and the included angle between the axis of the at least two light-emitting elements 5 and a vertical plane is 5°-30°. In the related art, the entire lamp bead is tilted with respect to the flame body so as to irradiate the entire lampshade 2. Thus, the lower part of the lampshade 2 and the mounting base 9 are provided with a plurality of tilted openings for accommodating corresponding lamp beads. The openings are of special-shaped structure and have relatively large area, which is not conducive to the adjustment and fixation of the lampshade 2. In this disclosure, the lamp bead 3 is vertically disposed, and the head of the at least two light-emitting elements 5 is tilted with respect to the lampshade 2 and a certain angle is formed between the head and the vertical plane. The design ensures the light can reach the lampshade 2, simplifies the structure of the lampshade 2 compared with a conventional one, reduces the processing cost, and facilitates the adjustment and fixation of the lampshade 2.

In another example, the flameless candle comprises at least three light-emitting elements 5, and the axis thereof and a vertical plane form an included angle of 5°-30°. The at least three light-emitting elements 5 are not in the same horizontal height, and are disposed in different vertical heights. For example, two light-emitting elements 5 are disposed higher than the rest one light-emitting element 5. The upper and lower light-emitting elements 5 can emit different colors of light. For example, the lower light-emitting element 5 emits a blue light, while the upper light-emitting elements 5 emit yellow lights. In this way, the internal and external flames of a flame can be simulated. Optionally, different colors of the light-emitting elements can be arranged to form multi-color and create different lighting effects.

In certain examples, as shown in FIG. 5, the second housing 4 comprises a reflector 10 disposed between the at least two light-emitting elements 5 and the circuit board 6; and the reflector 10 comprises a concave surface. The reflector 10 can be an aluminum sheet, an aluminum foil, or an electroplated metal layer. The design improves the concentrating effect and ensures the luminous brightness of the flameless candle.

In certain examples, the top surface of the second housing 4 is a converging surface, and the maximum included angle β between two lights respectively emitted from two end points of the converging surface is 10°-45°. Controlling the angle of the emitted lights is to concentrate the lights within the contour range of the flame body 21, so that the brightness of the lights is more concentrated and a more realistic flame can be produced.

In certain examples, the flame body 21 is disposed outside the vertical central through hole and comprises an arc surface, and the lamp bead 3 is disposed on the one side of the arc surface. In this way, the lights emitted from the lamp bead 3 can be concentrated in the frame head, thus improving the light intensity and producing realistic flame brightness.

In certain examples, the circuit board 6 comprises a remote module (not shown in the drawings) in wireless communication with an external remote controller provided with a switch button, a timing button and a flame intensity button; when in use, the external remote controller controls power on, power off, timing lighting and luminous intensity of the flameless candle through the circuit board 6.

The working principle of the flameless candle is detained as follows. When in use, the control switch 12 on the base 11 of the bottom part of the first housing 1 is turned on, and the power supply 7 supplies power to the circuit board 6 through the two guide pillars 8 electrically connected to the positive and negative terminals of the power source 7. The independent control chips on the circuit board 6 respectively transmit the light control signals of the light-emitting elements 5, so that while the light-emitting elements 5 are in the luminous state, the luminous intensity thereof is changed intermittently under the control of the light control signals, thus producing the flickering effect. In addition, the light control signals can control different light-emitting elements 5 to emit lights with different brightness changes according to varying frequencies. The lights with various brightness changes are irradiated on the flame body 21, to produce a realistic flickering effect of the flames.

The flameless candle of the disclosure can comprise only one lamp bead vertically disposed in the mounting base to simulate the flickering effect of flames, thus simplifying the structure of the flameless candle compared with a conventional one, reducing the processing cost of the mounting base, and facilitating the fixation and replacement of the flame bead. The flameless candle of the disclosure comprises at least two light-emitting elements 5 which can emit lights with varying brightness, and the frequency of the light emission, i.e. the change period of the light brightness, is irregular, thus improving the simulation effect of flickering flames.

It will be obvious to those skilled in the art that changes and modifications may be made, and therefore, the aim in the appended claims is to cover all such changes and modifications.

What is claimed is:

1. A lampshade, comprising:

a lampstand comprising a hollow column configured to accommodate a lamp bead of a flameless candle; and a flame body, the flame body being an integrated structure comprising a first curved surface, a second curved surface, and a first cavity defined by the first curved surface and the second curved surface;

wherein:

the first curved surface is perpendicularly disposed on the lampstand;

the second curved surface is aslant disposed on the lampstand with respect to the first curved surface;

the first curved surface and the second curved surface each comprise a top edge, two side edges, and a bottom edge; corresponding top edges and side edges of the first curved surface and the second curved surface are bonded to each other to form the first cavity; the bottom edge of the second curved surface and a connection line of two end points of the bottom edge of the first/second curved surface form a semicircular opening; and the hollow column comprises a first through hole corresponding to the semicircular opening in shape and size.

2. The lampshade of claim 1, wherein the flame body is a milky white semitransparent plastic; and the connection line is coincident with a center line of a surface of the lampstand oriented to the flame body.

3. The lampshade of claim 1, wherein the lampstand further comprises a base plate disposed below the hollow column; a diameter of the base plate is larger than that of the hollow column; and the hollow column is disposed on and internally tangent with the base plate.

4. The lampshade of claim 3, wherein the base plate comprises a second through hole to allow the lamp bead of the flameless candle to pass through the base plate; and the second through hole and the first through hole are eccentrically disposed thereby preventing a tip of the lamp bead of the flameless candle from extending into the first cavity.

5. The lampshade of claim 4, further comprising an annular support disposed below the base plate, wherein the annular support comprises a third through hole disposed in a center of the annular support; the third through hole is covered by the base plate and a mounting base is detachably disposed in the third through hole; and the lamp bead of the flameless candle is fixed in the mounting base.

6. A flameless candle, comprising:

1) a first housing comprising a second cavity;

2) a lampshade of claim 1, the lampshade being disposed on one end of the first housing;

3) a lamp bead disposed in the lampstand, the lamp bead comprising a second housing, at least two light-emitting elements, and a circuit board; and 4) a power source disposed in the second cavity;

wherein:

the at least two light-emitting elements and the circuit board are disposed in the second housing;

the at least two light-emitting elements each comprise a head tilted towards the first curved surface;

the circuit board is configured to control the at least two light-emitting elements to emit lights with varying brightness; and the power source is electrically connected to the circuit board.

7. The flameless candle of claim 6, wherein the circuit board is configured to output a control signal to control the at least two light-emitting elements to emit lights with irregular varying brightness, and a change frequency of the brightness of the lights of the at least two light-emitting elements is different from one another; and a change cycle of the control signal is 3-10 s.

8. The flameless candle of claim 7, wherein the circuit board comprises a first end and a second end; the at least two light-emitting elements are electrically connected to the first end of the circuit board; the second end is provided with two guide pillars electrically connected to positive and negative terminals of the power source, respectively; and the power supply is a dry battery or a rechargeable battery.

9. The flameless candle of claim 8, wherein the one end of the first housing comprises an opening; the hollow column is rotatably disposed in the opening through screw thread whereby a height of the flame body is adjustable.

10. The flameless candle of claim 9, wherein the circuit board comprises a remote module in wireless communication with an external remote controller provided with a switch button, a timing button and a flame intensity button; when in use, the external remote controller controls power on, power off, timing lighting and luminous intensity of the flameless candle through the circuit board.

* * * * *